US007607872B2

(12) United States Patent
Hulse et al.

(10) Patent No.: US 7,607,872 B2
(45) Date of Patent: Oct. 27, 2009

(54) METHOD FOR MACHINING A MOLDED PART AND MACHINE TOOL THEREFOR

(75) Inventors: Edward W. Hulse, Monroe City, MO (US); Kevin W. Pennewell, Palmyra, MO (US); James W. Dorsey, Monroe City, MO (US); Gregg A. Teel, Quincy, IL (US)

(73) Assignee: Buckhorn Rubber Products, Inc., Hannibal, MO (US)

( * ) Notice: Subject to any disclaimer, the term of this patent is extended or adjusted under 35 U.S.C. 154(b) by 621 days.

(21) Appl. No.: 11/348,573

(22) Filed: Feb. 7, 2006

(65) Prior Publication Data

US 2007/0183859 A1 Aug. 9, 2007

(51) Int. Cl.
*B23C 3/00* (2006.01)
*B23C 1/025* (2006.01)

(52) U.S. Cl. ..... 409/134; 409/145; 409/160; 409/163; 409/147; 409/140; 409/143; 269/47; 269/228; 269/305; 269/32; 269/289 R; 451/51; 451/213; 29/557; 29/890.121

(58) Field of Classification Search ..... 409/160, 409/163, 145, 159, 164, 139–140, 143, 134, 409/147; 407/119, 30, 33, 34, 42, 40; 269/45, 269/47, 152, 228, 305, 315, 32, 27, 43, 71, 269/73, 266, 289 R; 29/557–558, 890.121; 451/11, 51, 212, 213
See application file for complete search history.

(56) References Cited

U.S. PATENT DOCUMENTS

| | | | | |
|---|---|---|---|---|
| 367,954 | A | 8/1887 | Brainard | |
| 542,461 | A | 7/1895 | Bogert | |
| 615,313 | A | 12/1898 | Shedin | |
| 1,120,650 | A | 12/1914 | Einstein | |
| 1,126,634 | A | 1/1915 | Hazelton et al. | |
| 1,174,815 | A | 3/1916 | Briggs | |
| 1,241,850 | A | 10/1917 | Humphreys | |
| 1,521,080 | A | 12/1924 | Deitmann | |
| 1,989,611 | A | 1/1935 | Dall et al. | |
| 1,994,221 | A | 3/1935 | Kearney et al. | |
| 2,533,753 | A * | 12/1950 | Armitage et al. | 409/160 |
| 2,605,678 | A | 8/1952 | Armitage et al. | |
| 4,655,268 | A | 4/1987 | Lundblom | |
| 4,733,995 | A * | 3/1988 | Aebi | 407/34 |
| 4,830,074 | A | 5/1989 | Lundblom | |
| 4,995,766 | A * | 2/1991 | Coleman | 407/34 |
| 5,597,268 | A * | 1/1997 | Izumi | 407/51 |
| 5,657,961 | A | 8/1997 | Kalsi et al. | |
| 5,882,156 | A | 3/1999 | Hetzler | |
| 6,286,823 | B1 * | 9/2001 | Morghen | 269/47 |

(Continued)

FOREIGN PATENT DOCUMENTS

| | | | |
|---|---|---|---|
| DE | 10034973 | A1 * | 2/2002 |

(Continued)

*Primary Examiner*—Erica E Cadugan
(74) *Attorney, Agent, or Firm*—Senniger Powers LLP

(57) ABSTRACT

A machine tool for machining a molded part, such as an elastomeric coated valve component includes a rotatable cutting tool having a shape corresponding to the shape of a cavity of the valve component. A method of machining the molded part is also disclosed.

14 Claims, 17 Drawing Sheets

U.S. PATENT DOCUMENTS 6,338,469 B1 1/2002 Kalsi et al.
6,488,450 B2 * 12/2002 Norris ..... 407/35

FOREIGN PATENT DOCUMENTS

EP 962279 A2 * 12/1999
GB 1540718 A * 2/1979
JP 55-96221 7/1980
SU 1705027 A1 * 1/1992
WO WO-02/00390 A1 * 1/2002

* cited by examiner

METHOD FOR MACHINING A MOLDED PART AND MACHINE TOOL THEREFOR

BACKGROUND OF THE INVENTION

The present invention relates to a method for machining molded or an elastomeric coated part, and a machine tool for performing the machining.

Valves having an elastomeric or elastomeric-coated valve component are commonly used to ensure a tight seal between the valve and an associated structure when the valve is closed. The valve component is typically connected to a valve stem for positioning the valve component in an open or closed position. For example, a wedge gate valve is commonly used to control the flow of fluid through a pipe or conduit, particularly in waterworks and gas services. As illustrated, the conventional wedge-shaped disk has a T-shaped slot or cavity formed in an upper portion for receiving a corresponding T-shaped free end or T-nut of the valve stem member for connecting the disk to the stem member.

Molding, such as injection molding, is a common process of making elastomeric or elastomeric parts, such as coated valve components. For example, with injection molding, melted resin (i.e., elastomeric material) is injected at a high pressure into a cavity of a mold. The resin solidifies in the mold to form the valve component. The mold comprises at least two parts, each part defining a portion of the cavity of the mold. The mold is adapted to be separated after the molding process to allow for the molded valve member to be extracted from the mold. During the molding process, excess resin called "flash" flows beyond the edges of the mold into the location where the parts of the mold come together (called the "parting line"). The flash freezes to form a thin, sheet-like protrusion from the valve component.

It is desirable to trim the flash, particularly flash present in a slot of an applicable valve because the slot is sized and shaped to snugly receive the valve stem and the presence of flash or at least access flash inside the slot may interfere with or even prevent the ability of the valve stem to fit in the slot. The flash is conventionally trimmed manually using either a hot or cold cutting device such as a razor or a knife. This process, however, is inefficient, labor-intensive and time-consuming because the trimming is performed manually. Moreover, the quality of manually trimmed slots may be poor. For example, a worker may fail to trim an adequate amount of the flash, making it difficult to fit the valve stem in the slot, or the worker may trim beyond the flash, into the elastomeric coating, creating gaps between the valve stem and the slot when the stem is received in the slot.

SUMMARY OF THE INVENTION

One aspect of the invention is a method of machining an elastomeric coated valve component. The valve component includes a cast core coated by a non-uniform elastomeric coating. The coated valve component includes an outer periphery and a cavity formed by at least two elastomeric surfaces extending inward from the periphery. The elastomeric surfaces of the cavity are non-uniform in an as-coated condition due to the coating process. The method comprises providing a machine tool having a rotatable cutting tool, a positioning fixture conforming to portions of the component outer periphery, and a motor for moving at least one of the cutting tool and the fixture relative to one another. The method further comprises positioning the coated valve component on the positioning fixture to thereby fix the cavity surfaces relative to the cutting tool and actuating the machine tool. The machine tool thereafter automatically rotates the cutting tool and moves at least one of the cutting tool and the valve component to machine at least the cavity surfaces and thereby make the cavity surfaces more uniform than in the as-coated condition. Other aspects of the invention are directed to the machine tool for machining the elastomeric coated valve component. For example, the tool comprises a fixture sized and shaped for engaging portions of the outer periphery of the valve component and for fixing the position of the valve component on the machine tool. A rotatable cutting tool is disposed a predetermined distance from the fixture and has a shape corresponding to the shape of the valve component cavity.

Various refinements exist of the features noted in relation to the above-mentioned aspects of the present invention. Further features may also be incorporated in the above-mentioned aspects of the present invention as well. These refinements and additional features may exist individually or in any combination. For instance, various features discussed below in relation to any of the illustrated embodiments of the present invention may be incorporated into any of the above-described aspects of the present invention, alone or in any combination.

BRIEF DESCRIPTION OF THE DRAWINGS

Corresponding reference characters indicate corresponding parts throughout the drawings.

DETAILED DESCRIPTION OF THE DRAWINGS

Figure 1:
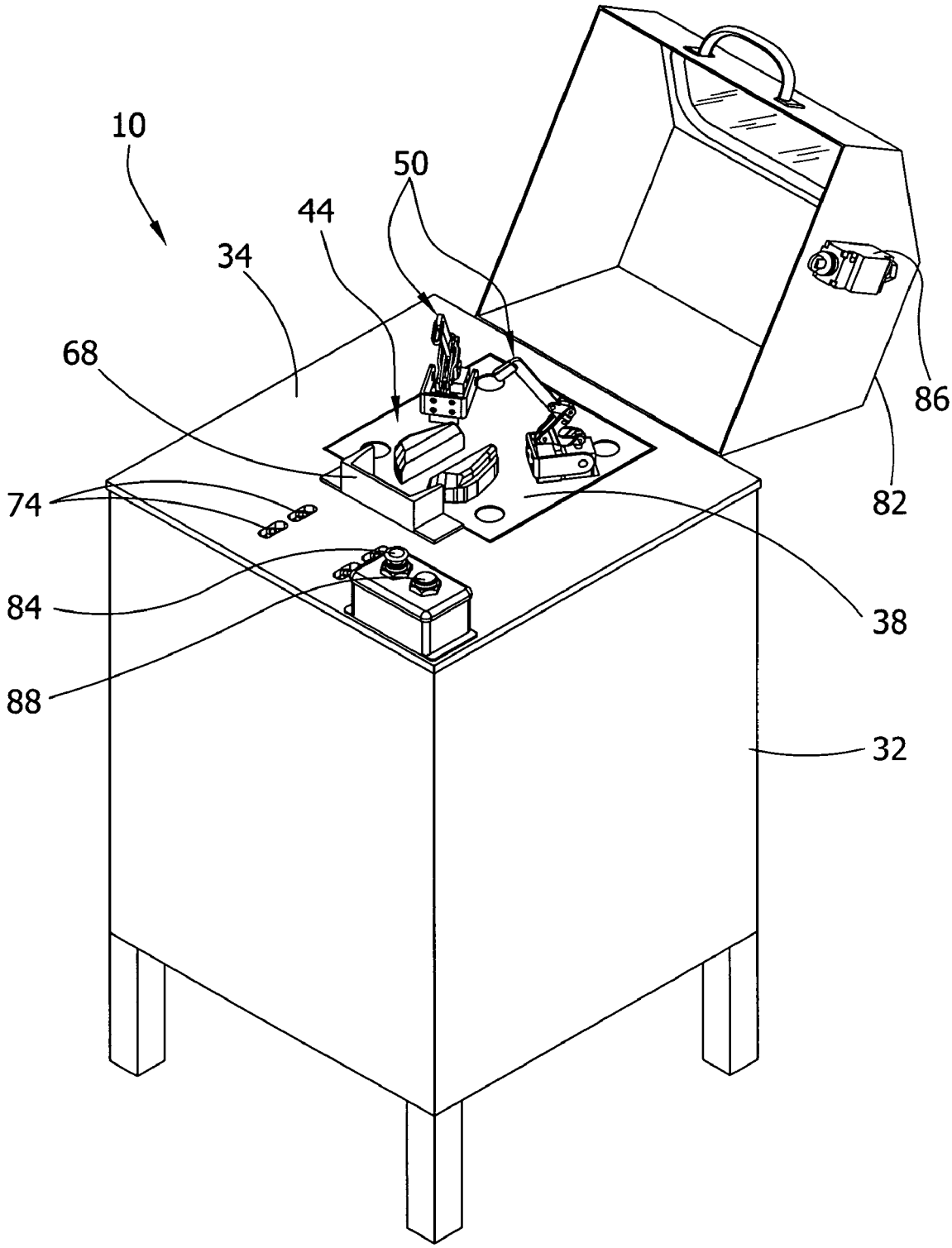
FIG. 1 is a perspective of a machine tool of one embodiment for machining a molded part.

Referring now to the drawings, one embodiment of a machine tool constructed according to the teachings of the present invention is generally indicated by reference numeral 10. The machine tool 10 is adapted to remove flash and/or other excess material from an elastomeric interior surface defining a cavity (e.g., a slot) of a molded part. For example, the illustrated machine tool 10 is adapted to remove flash and/or other excess material from an interior surface defining a T-shaped slot of a wedge gate valve component. It is understood, however, that the machine tool 10 of the present invention may be used to remove flash from cavities of other types of valves and other types of coated parts.

Figure 3:
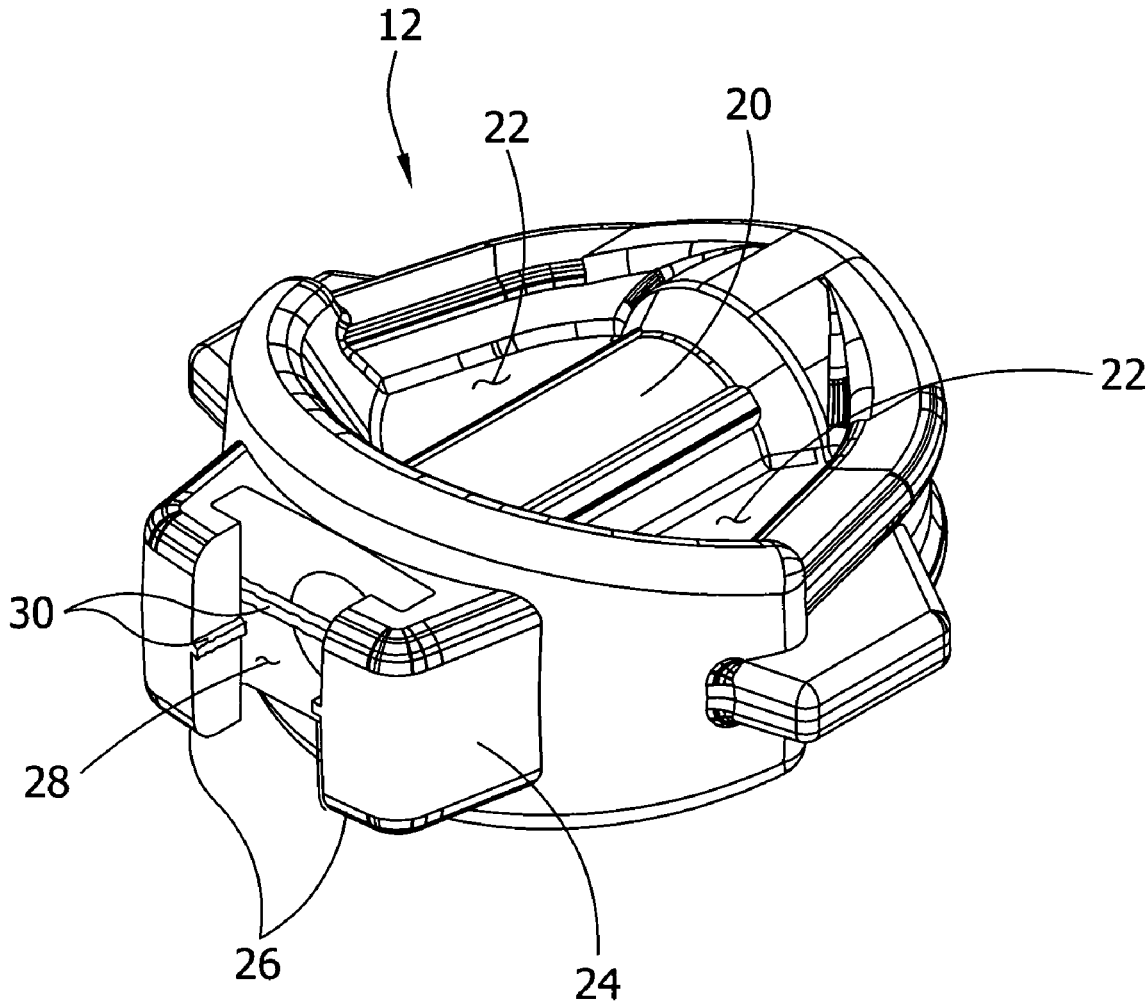
FIG. 3 is a perspective of an as-coated valve component.
Figure 4:
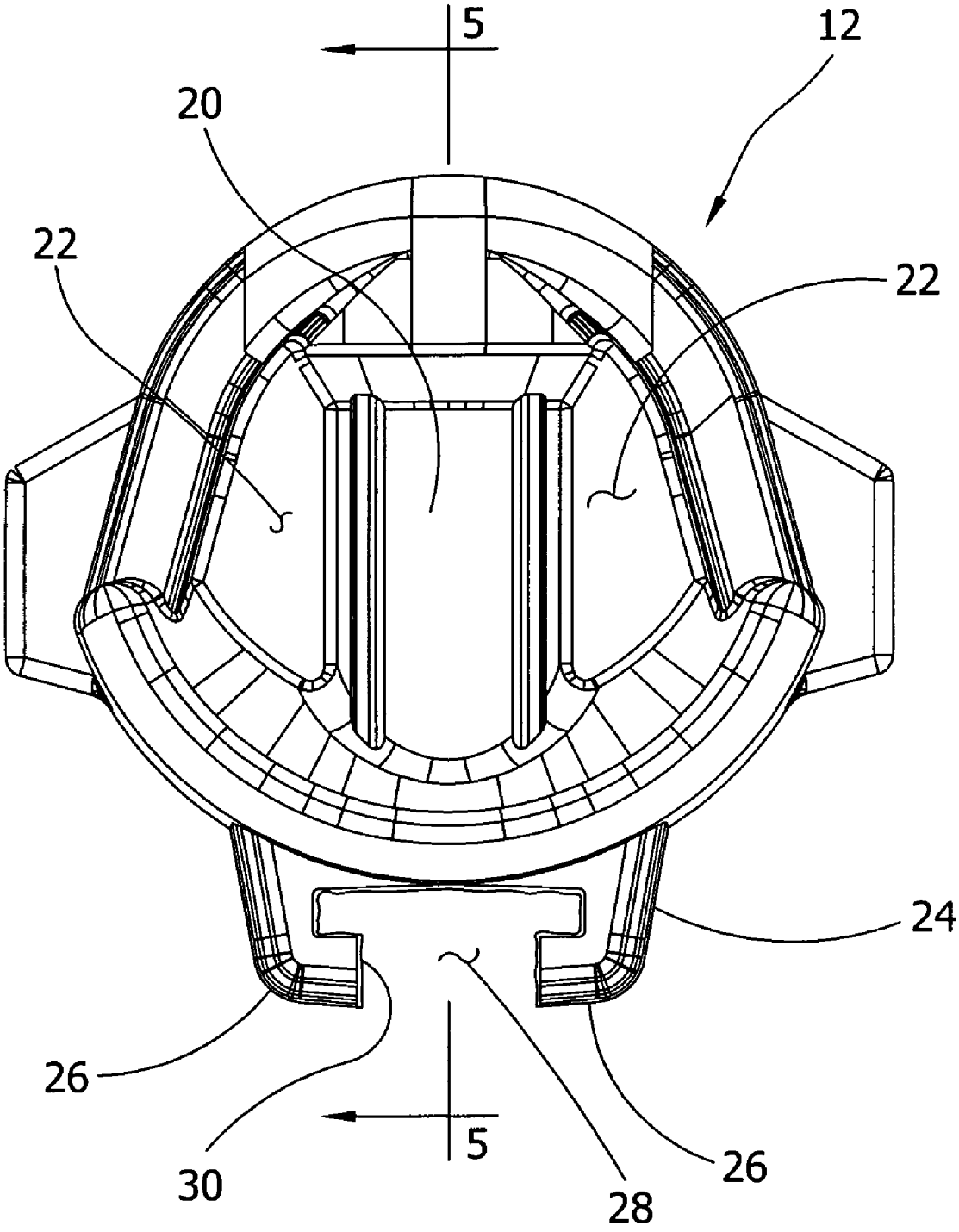
FIG. 4 is a top plan view of the valve component.
Figure 5:
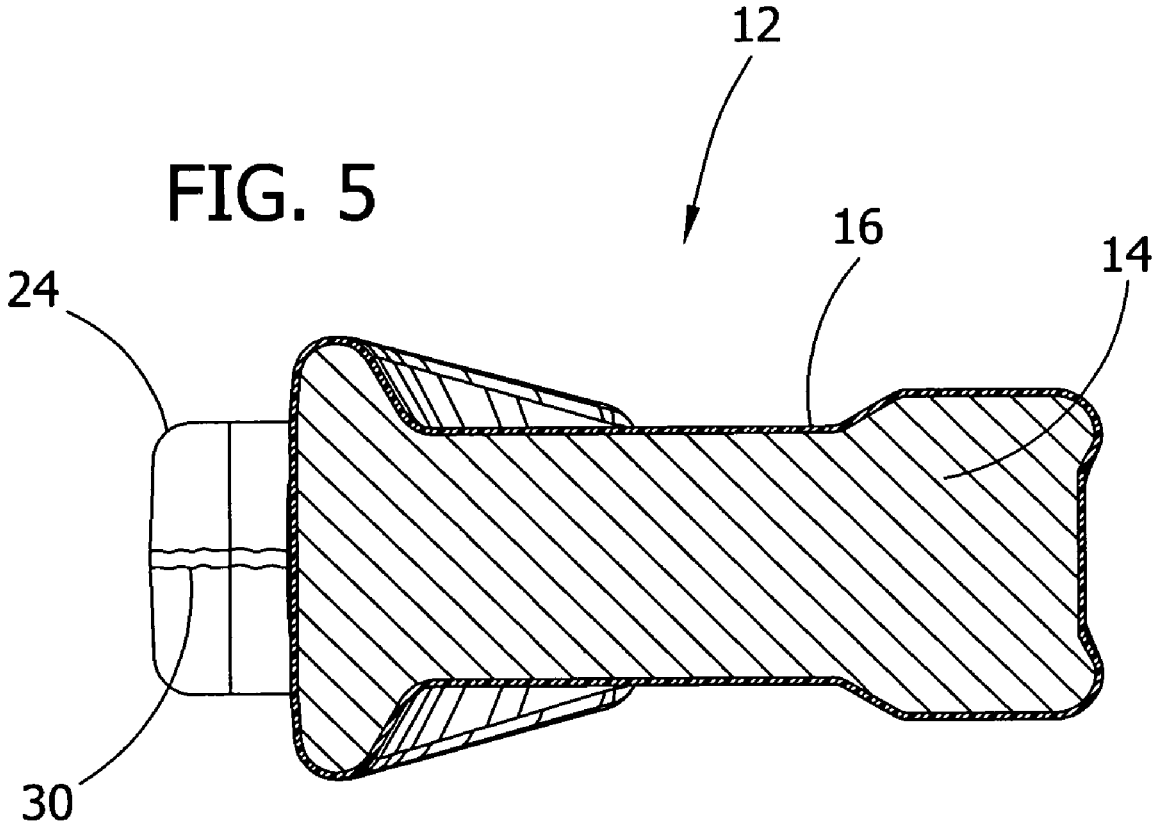
FIG. 5 is a sectional view of the valve component taken in the plane including the line 5-5 of FIG. 4.

Referring to FIGS. 3-5, an exemplary elastomeric wedge-shaped valve component of a wedge gate valve is generally indicated by reference numeral 12. The valve component 12 comprises, for example, a core 14, such as cast metal, substantially covered by an elastomeric coating 16, such as rubber (FIG. 5). The core 14 includes an outer periphery and a pair of opposite faces defined by the periphery. A center post 20 disposed within the periphery projects outward from each of the faces and together with the periphery defines a pair of opposite, symmetric recesses 22 in each face. The valve component may have a different construction than the exemplary wedge-shaped valve component 12 described above and illustrated in FIGS. 3-5.

The valve component 12 has a coupling member 24 (FIGS. 3 and 4) extending from the outer periphery for connecting the component to a valve stem member (not shown). The coupling member 24 includes a pair of shoulders 26 having opposed interior surfaces defining a T-shaped slot 28 (broadly, a cavity). The T-shaped slot 28 includes a lower portion adjacent the periphery of the valve and an upper portion, both of which are sized and shaped for receiving a corresponding T-shaped portion or end of a valve stem member. When the valve stem member is received in the slot 28, the shoulders 26 engage the valve stem to connect the valve component 12 to the valve stem. As is typical in the art, the valve component 12 may be formed by injection molding the elastomeric coating 16 around the cast core 14. During injection molding, flash flows into a parting line of the mold located along the periphery of the valve component 12 and along the interior surface of the coupling member 24 defining the T-shaped slot. As shown in FIGS. 3 and 4, the flash solidifies to form a thin, sheet-like protrusion 30 running along the interior surface of the coupling member 24.

Figure 15:
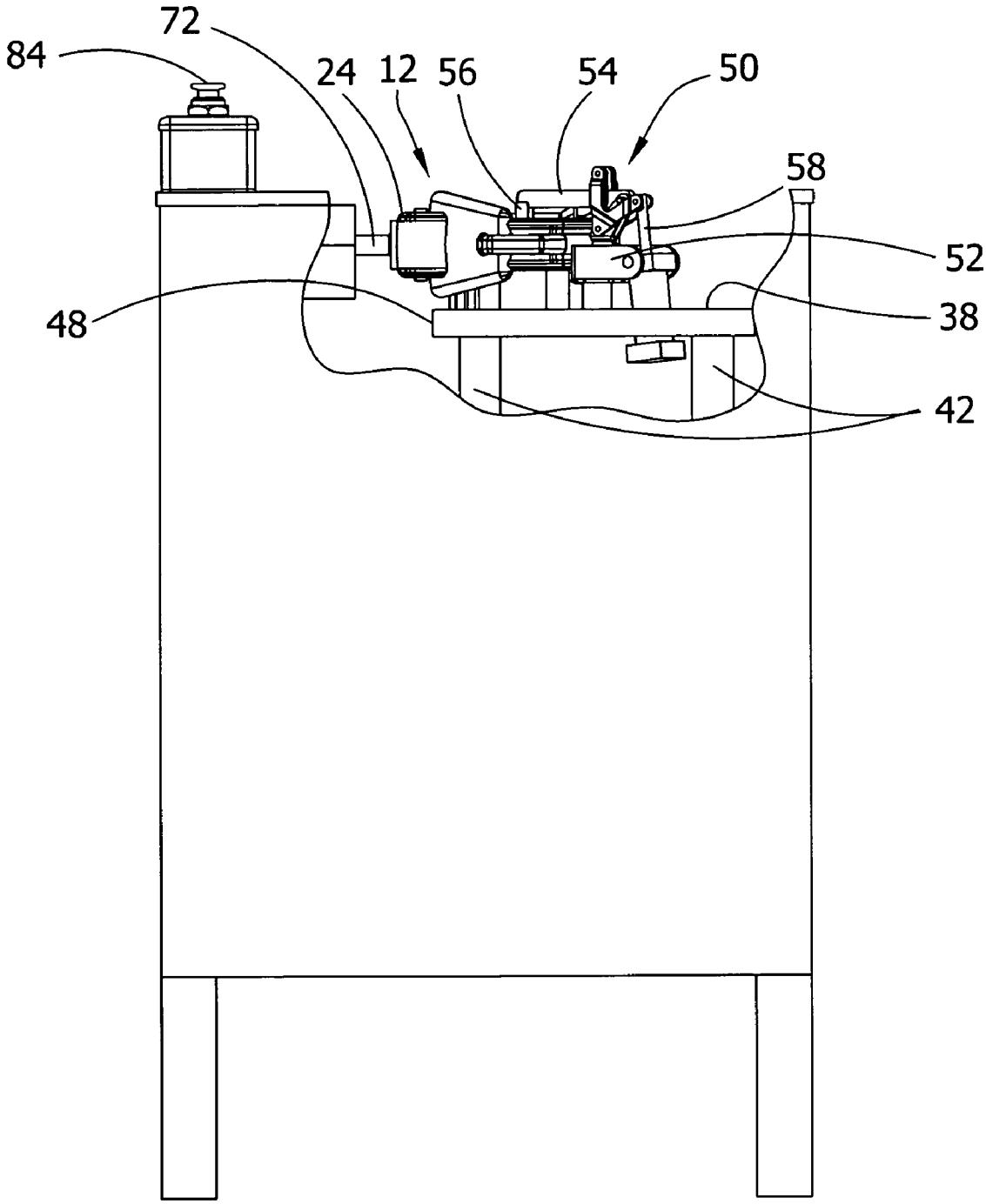
FIG. 15 is a side elevational view of the machine tool similar to FIG. 14, the head of the cutting tool being received in the cavity of the valve component.
Figure 15A:
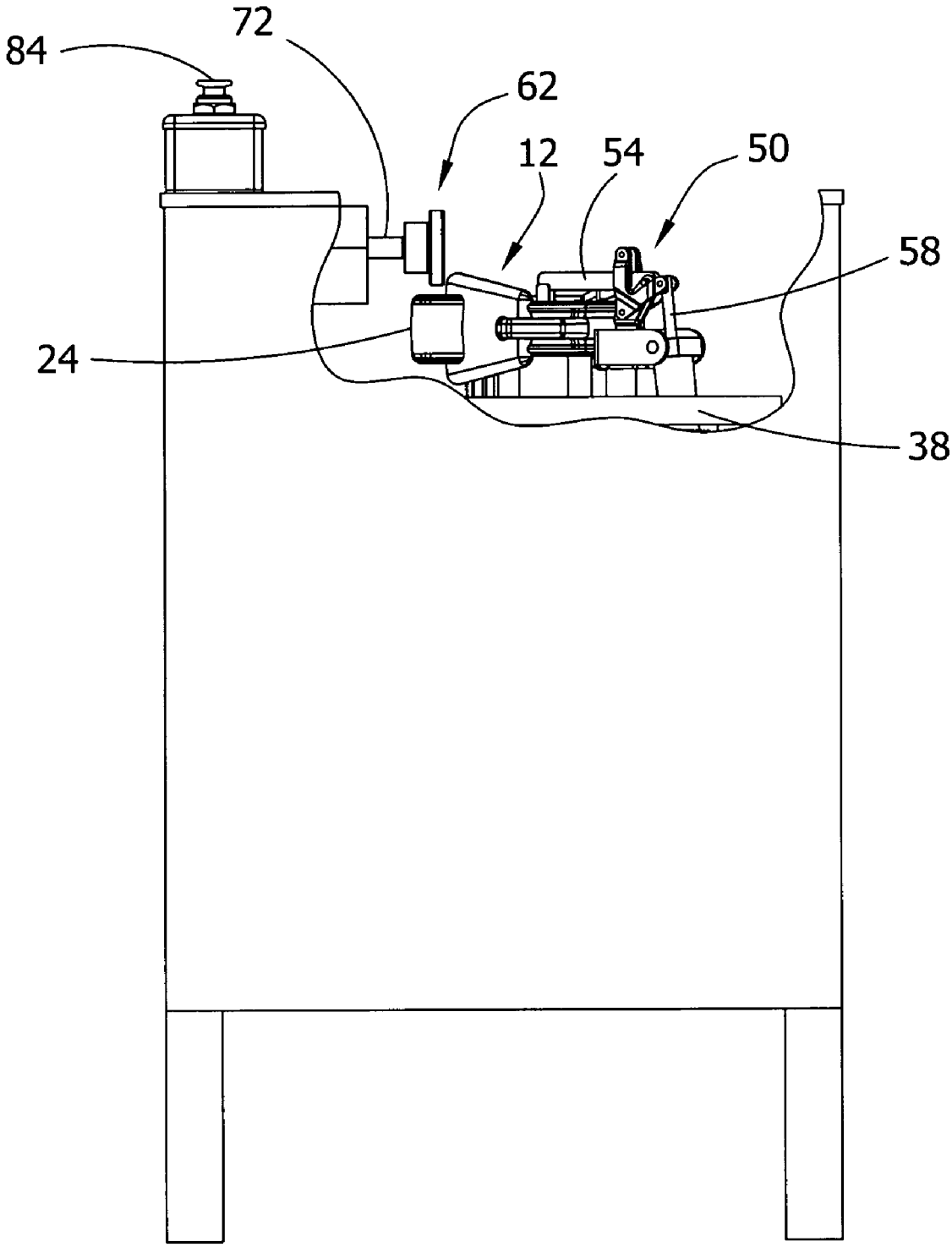
FIG. 15A is a side elevational view of the machine tool similar to FIG. 15, the platform being in a lower position.

Referring to FIGS. 1, 2, 6 and 7, the machine tool 10 includes a housing 32 having an upper surface 34. A generally rectangular opening 36 (FIGS. 6 and 7) is formed in the upper surface 34, and a vertically movable platform 38 is received in the opening. As discussed below, the platform 38 is movable between an upper position in which the platform is substantially flush with the upper surface 34 of the housing 32 and a lower position in which the platform is disposed below the upper surface of the housing (as shown in FIG. 15A). For purposes discussed below, the upper surface 34 of the housing 32 includes a U-shaped cutout 40 (FIG. 7) contiguous with the rectangular opening 36 to form a single hole in the upper surface. The housing 32 may be formed of a generally rigid material, such as metal.

As shown best in FIGS. 2 and 13-15A, vertical pistons 42 contact and/or are connected to the platform 38 for moving the platform up and down. The pistons 42 may be either hydraulic pistons or pneumatic pistons or other types of pistons suitable for holding and moving the weight of the platform 38. The operations of these types of pistons 42 are generally known in the art, and therefore, will not being described in detail herein. The platform 38 may be moved in other ways without departing from the scope of this invention.

Figure 6:
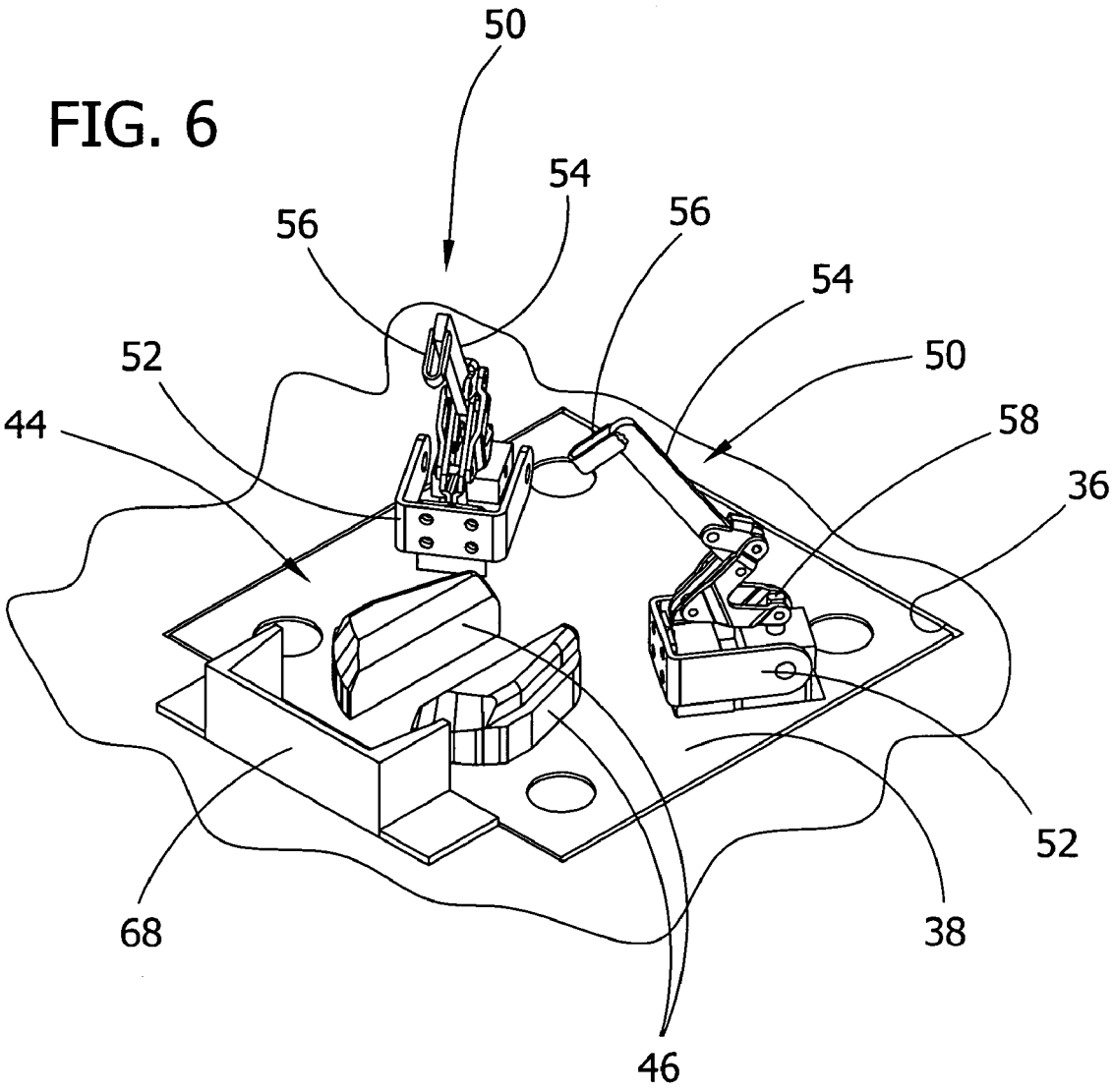
FIG. 6 is an enlarged partial perspective of a top surface of the machine tool.
Figure 7:
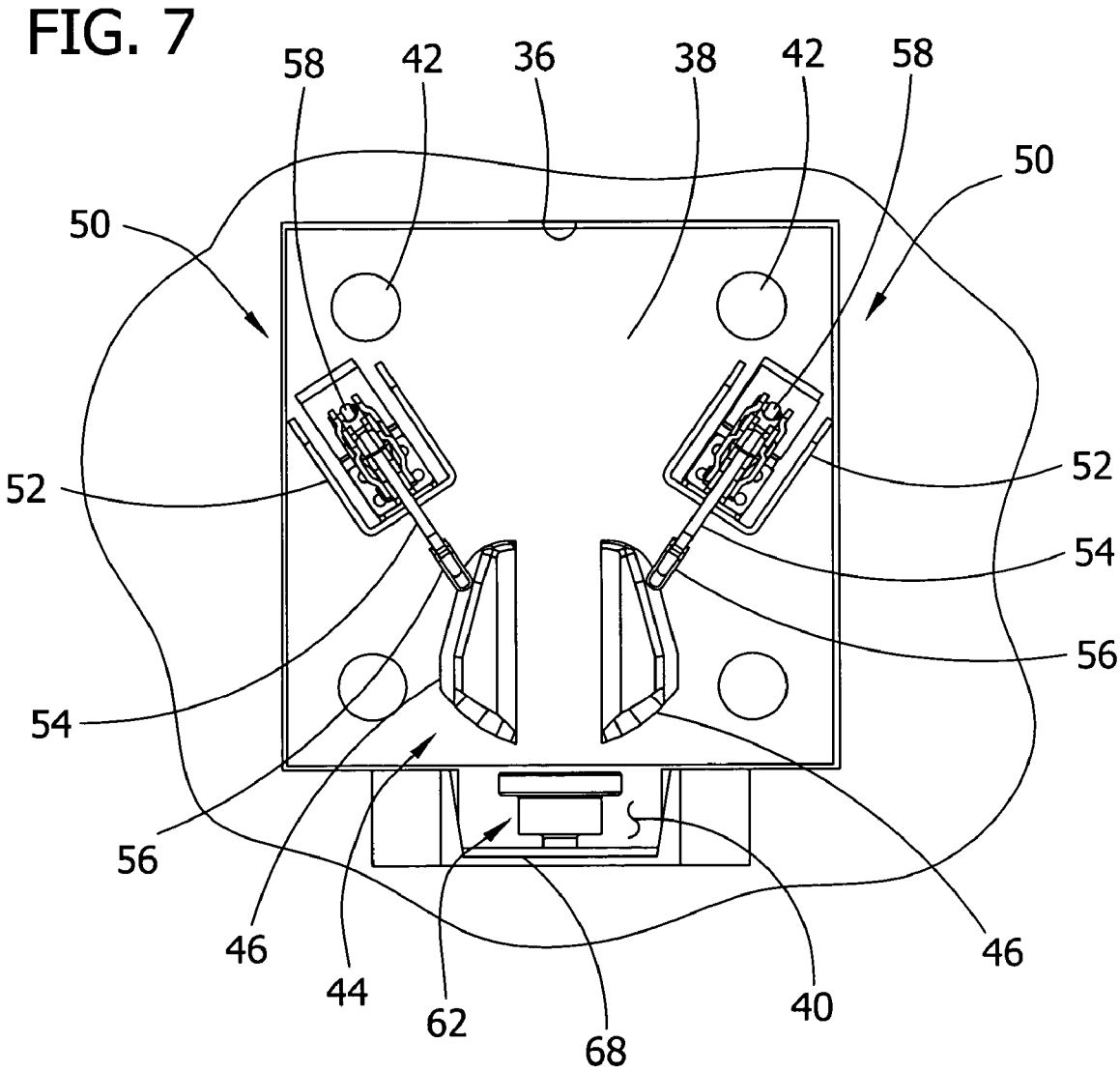
FIG. 7 is an enlarged partial top plan view of the top surface of the machine tool.
Figure 8:
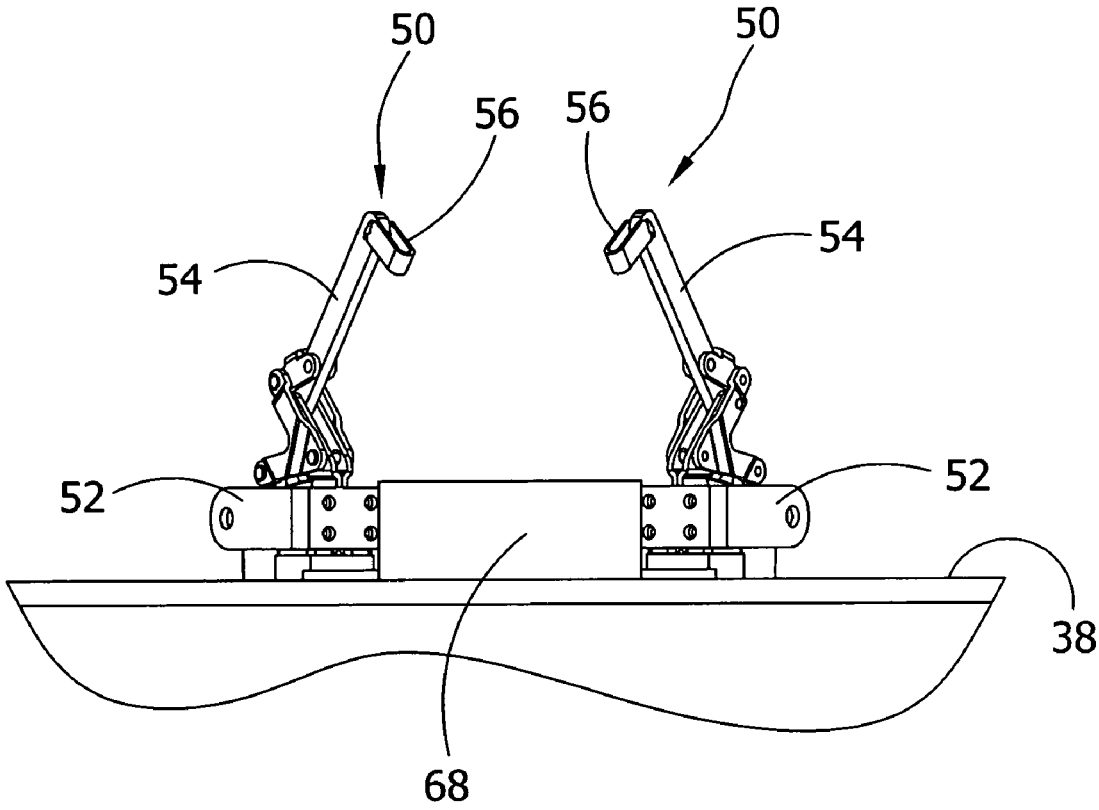
FIG. 8 is an enlarged partial front elevational view of the top surface of the machine tool.
Figure 9:
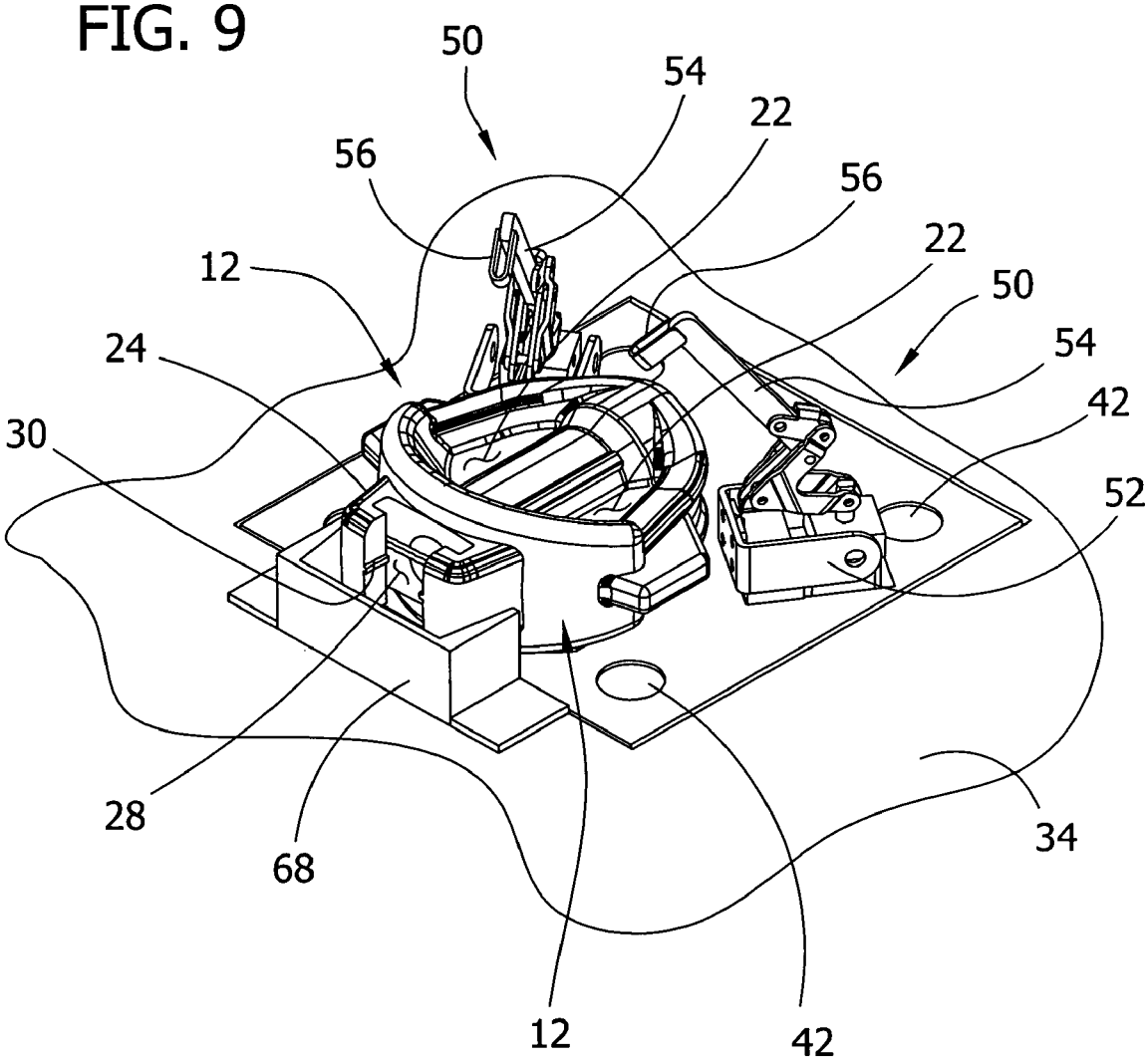
FIG. 9 is an enlarged partial perspective of the top surface of the machine tool with the valve component mounted thereon and clamps of the machine tool in a retracted position.
Figure 10:
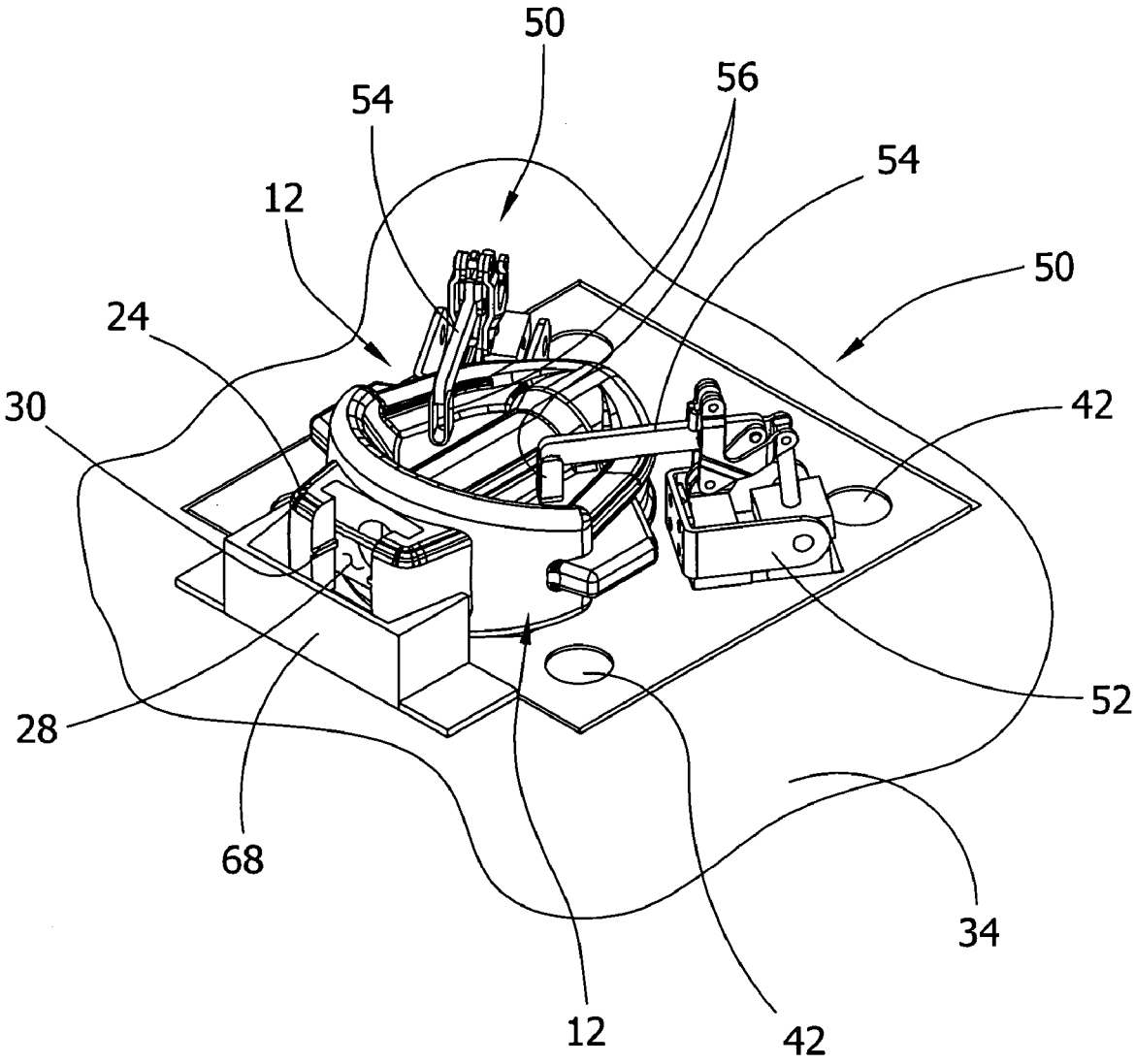
FIG. 10 is an enlarged partial perspective of the top surface of the machine tool, similar to FIG. 9, with the clamps in an engagement position.

Referring to FIGS. 1, 6 and 7, a positioning fixture, generally indicated at 44, disposed on the platform 38 is sized and shaped for fixing the position of the valve component 12 on the platform. The positioning fixture 44 comprises a pair of spaced apart, symmetric fixture members 46 projecting upward from the platform 38. The fixture members 46 are sized and shaped to be received in the spaced apart symmetric recesses 22 of the valve component 12. As discussed below, the fixture members 46 are positioned on the platform 38 such that the coupling member 24 of the valve component 12 extends laterally outward from an edge 48 of the platform over the U-shaped cutout 40 when the valve component is positioned on the positioning fixture 44. The U-shaped cutout 40 is sized and shaped to allow the coupling member 24 to pass therethrough as the platform 38 moves up and down.

Referring to FIGS. 1 and 6-11, a pair of clamps, generally indicated at 50, located on the platform 38 is adapted to further secure the valve component 12 on the positioning fixture 44. In the illustrated embodiment, each clamp 50 comprises a base 52 secured to the platform 38 and an elongate arm 54 pivotally secured to the base. A contact member 56 extends generally orthogonally from the arm 54. Each clamp 50 is moveable between a retracted position and an engagement position. In the retracted position (FIGS. 1 and 6-9), the arm 54 is generally upright relative to the platform 38. In the engagement position (FIGS. 10-11), each arm 54 pivots downward, toward the platform 38, and the contact member 56 contacts the valve component 12 inside the recess 22 of the valve component to press the valve component against the corresponding fixture member 46. Other ways of securing the valve component 12 to the positioning fixture 44 are within the scope of this invention.

In the illustrated embodiment, each clamp 50 is moveable between the retracted position and the engagement position by way of a piston 58 secured to the base 52. As shown best in FIGS. 9 and 10, the piston 58 is vertically moveable and may be, for example, hydraulically or pneumatically powered. When the piston 58 is moved upward (FIG. 10), it moves the associated clamp 50 in the engagement position, and when it is moved downward (FIG. 9), it moves the associated clamp into its retracted position. Other ways of moving the clamp 50 between its retracted and engagement positions are within the scope of this invention.

Referring to FIGS. 7 and 11-14, a rotatable cutting tool, generally indicated at 60, is disposed below the upper surface 34 within the housing 32 and is horizontally spaced from the edge 48 of the platform 38. In the illustrated embodiment, the cutting tool 60 includes a cylindrical head, generally indicated at 62, having a T-shaped longitudinal section sized and shaped to correspond with the T-shaped slot 28 of the valve component 12. For example, as shown best in FIG. 11, the head 62 may include a larger disk 64 having a width and a diameter for being received in the lower portion of the T-shaped slot 28 and a smaller disk 66 projecting axially from the larger disk and having a width and a diameter for being received in the upper portion of the T-shaped slot. The size and shape of the head 62 of the cutting tool 60 may vary within the scope of the invention. For example, the size and/or the shape of the head 62 may depend on the size and/or the shape of a cavity of a valve component. The head 62 may be constructed from 4140 steel and coated with an abrasive, such as an abrasive including Tungsten Carbide, although it may be constructed from other materials within the scope of this invention.

Figure 11:
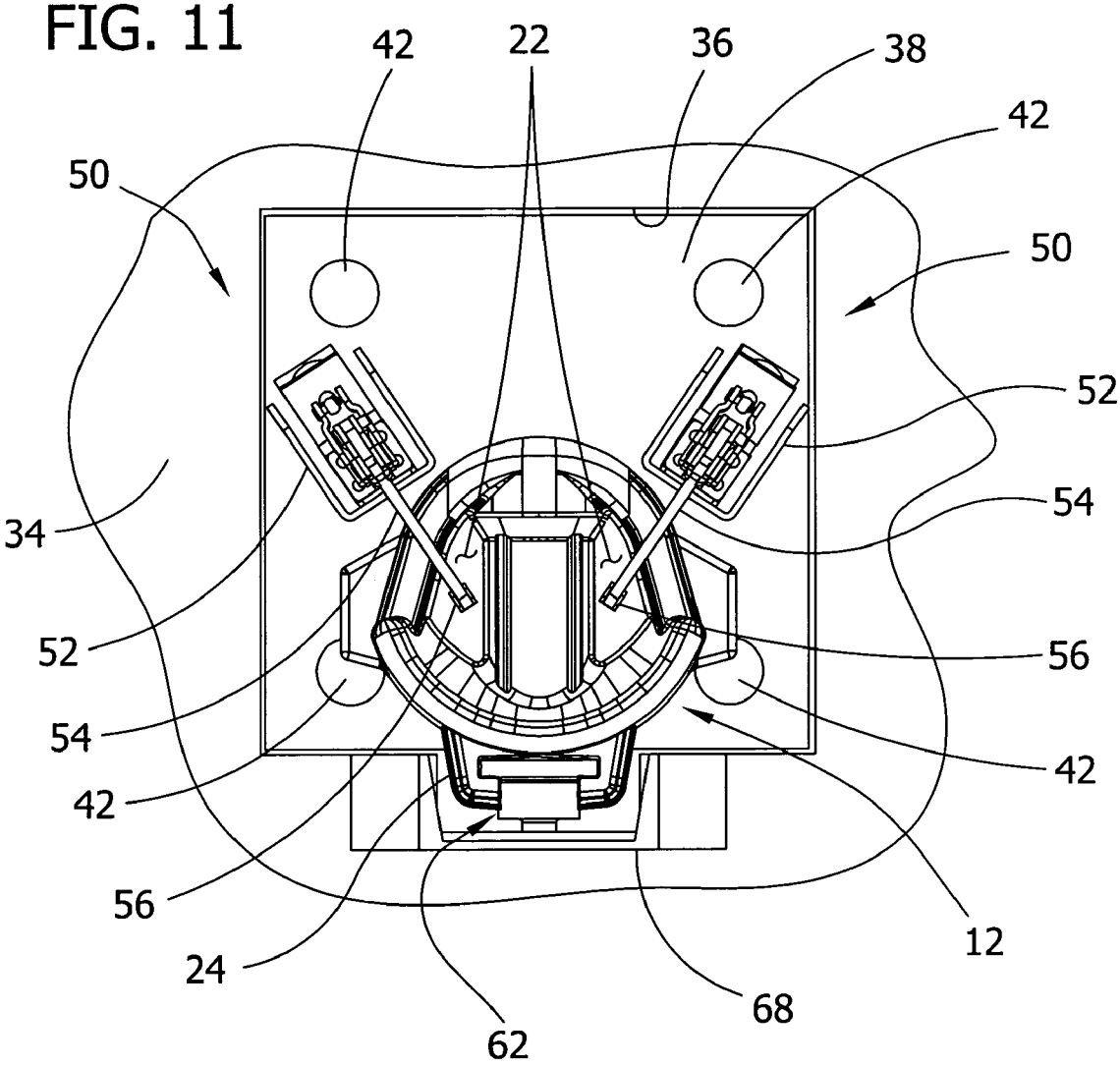
FIG. 11 is a top plan view showing the clamps in an engaging position.
Figure 12:
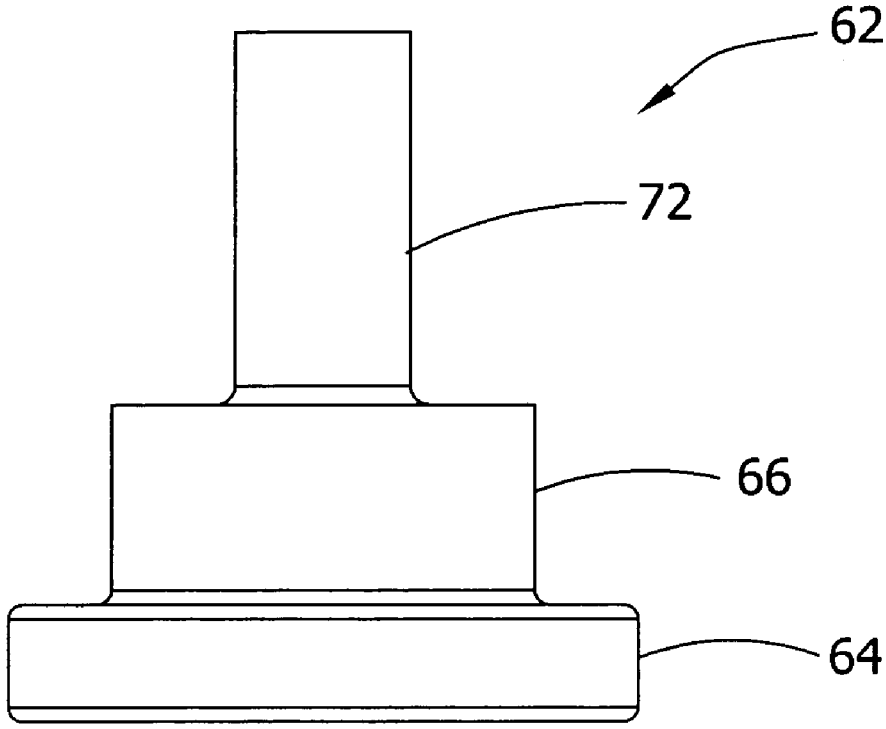
FIG. 12 is a top plan view of a head of a cutting tool of the machine tool.
Figure 13:
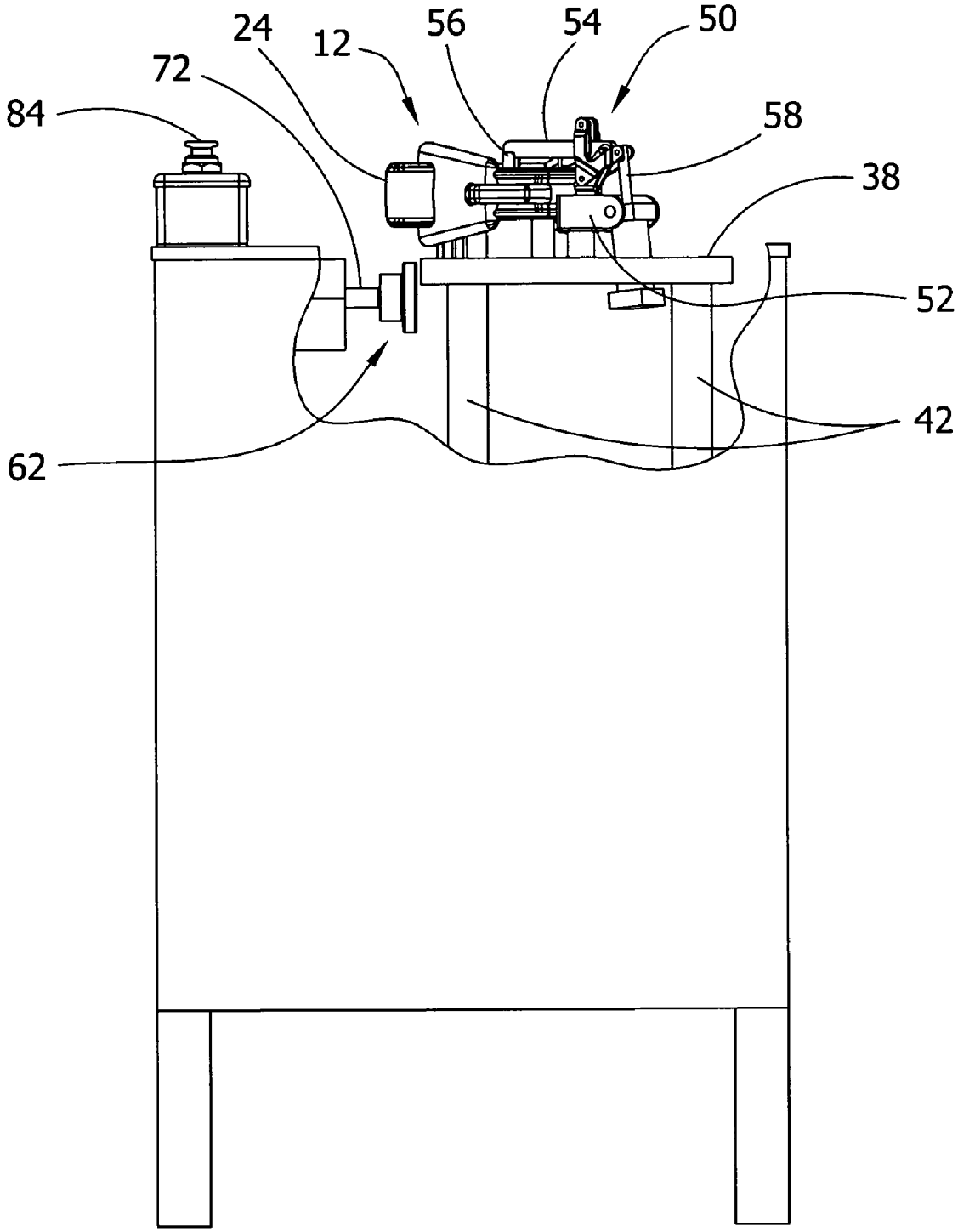
FIG. 13 is a side elevational view of the machine tool, a platform of the tool being in an upper position and the housing being partially removed to show internal components.
Figure 14:
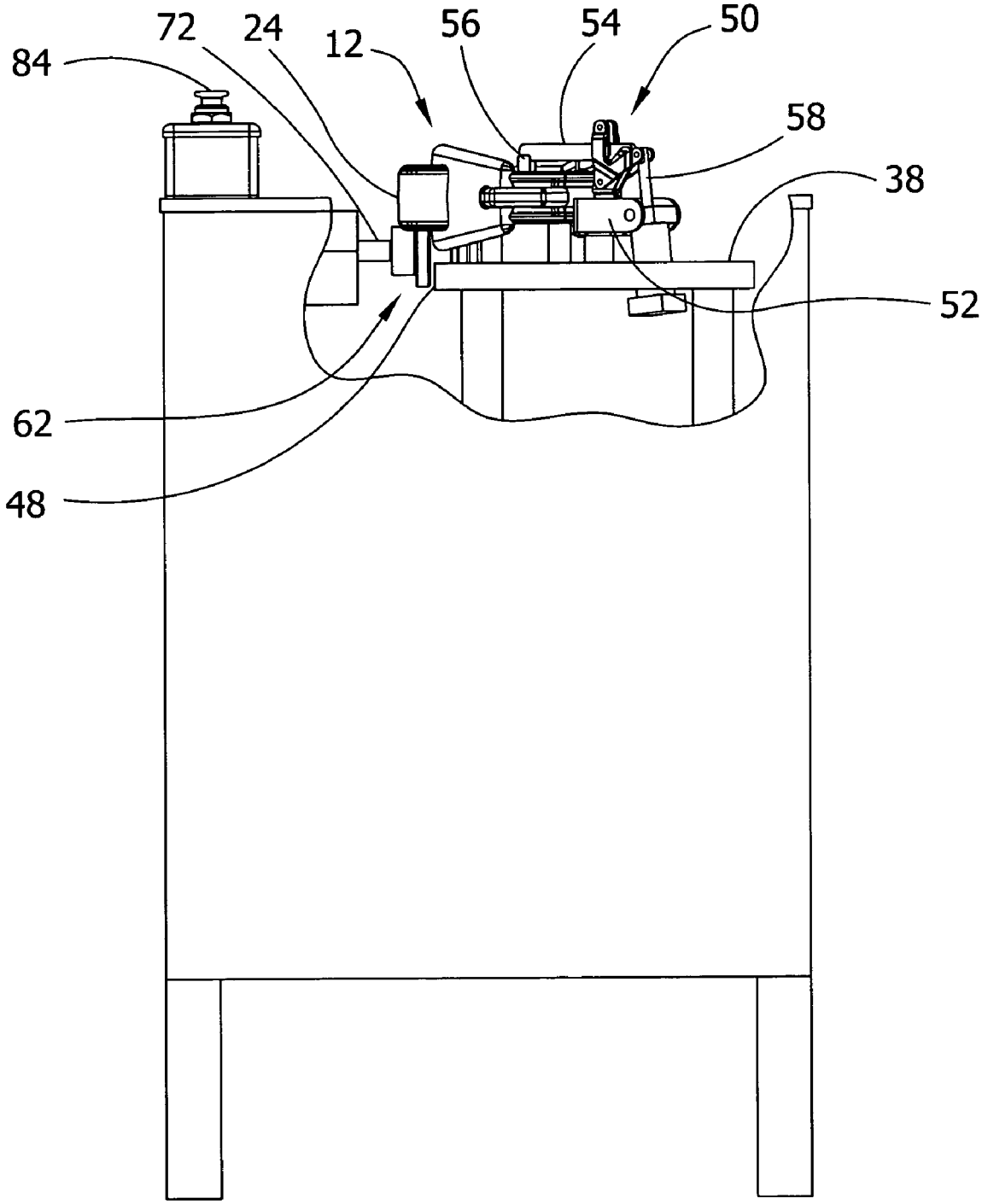
FIG. 14 is a side elevational view of the machine tool similar to FIG. 13, the platform being in a position below its upper position and the head of the cutting tool entering a cavity of the valve component.

As shown best in FIG. 11, the head 62 of the cutting tool 60 is generally vertically aligned with the U-shaped cutout 40 in the upper surface 34 of the housing 32. Moreover, when the valve component 12 is positioned on the platform 38, the T-shaped slot 28 of the valve component, the U-shaped cutout 40 and the head 62 of the cutting tool 60 are all generally vertically aligned. For safety purposes, a U-shaped guard 68 may extend around a perimeter of the U-shaped cutout 40.

Figure 2:
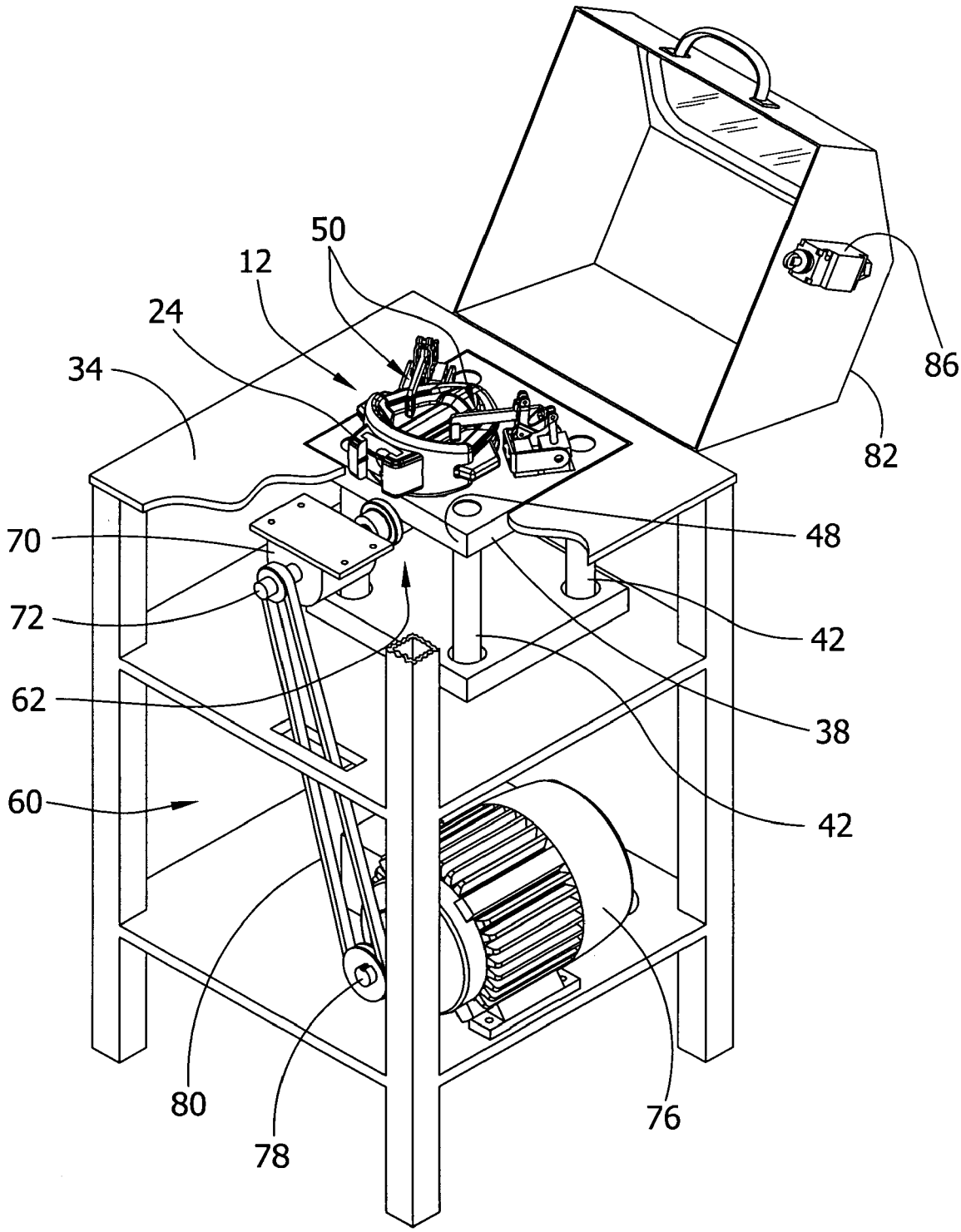
FIG. 2 a perspective of the machine tool with housing of the tool partially removed to show internal components.

Referring to FIG. 2, the cutting tool 60 includes a mount 70 to secure the head 62 of the cutting tool the housing 32. The mount 70 includes a bearing (not shown) through which a shaft 72 (FIGS. 2 and 12) of the head 62 of the cutting tool 60 extends to allow the shaft to rotate freely within the mount. The mount 70 is slidably secured to the housing 32 by a plurality of bolts 74 (FIG. 1). The horizontal position of the head 62 of the cutting tool 60 (i.e., the position of the head relative to the platform 38) may be selectively adjusted by loosening the bolts 74, sliding the mount 70 into a selected horizontal position, and then tightening the bolts to retain the head of the cutting device in the selected position. Other ways of selectively adjusting the position of the head 62 are within the scope of this invention. Alternatively, the head 62 may have a fixed position that is not selectively adjustable.

Referring to FIG. 2, a motor 76 (e.g., an electrical motor) disposed below the head 62 of the cutting tool 60 within the housing 32 drives the rotational movement of the head. A belt 80 connects an output shaft 78 of the motor 76 to the shaft 72 of the head 62. The rotational drive of the output shaft 78 turns the belt 80, thereby imparting rotational movement of the shaft 72 and the head 62. The head 62 rotates in a plane generally orthogonal to the plane defined by the platform 38. Other ways of imparting rotational movement of the head 62 of the cutting tool 60 are within the scope of this invention.

The machine tool 10 may also comprise a device (note shown) for trimming other portions of the coating 16 besides portions of the coating within cavities of the valve component 12. For example, such a device may trim along the outer periphery of the valve component or other portions of the coating. Moreover, other machine tools are also envisioned within the scope of the invention, such as those that include cutting tools mounted on a multi-axis robotic arm. Such a machine may be programmed to trim the coating along other portions of the valve component, e.g., along the outer periphery, as well as the cavity surfaces.

Figure 16:
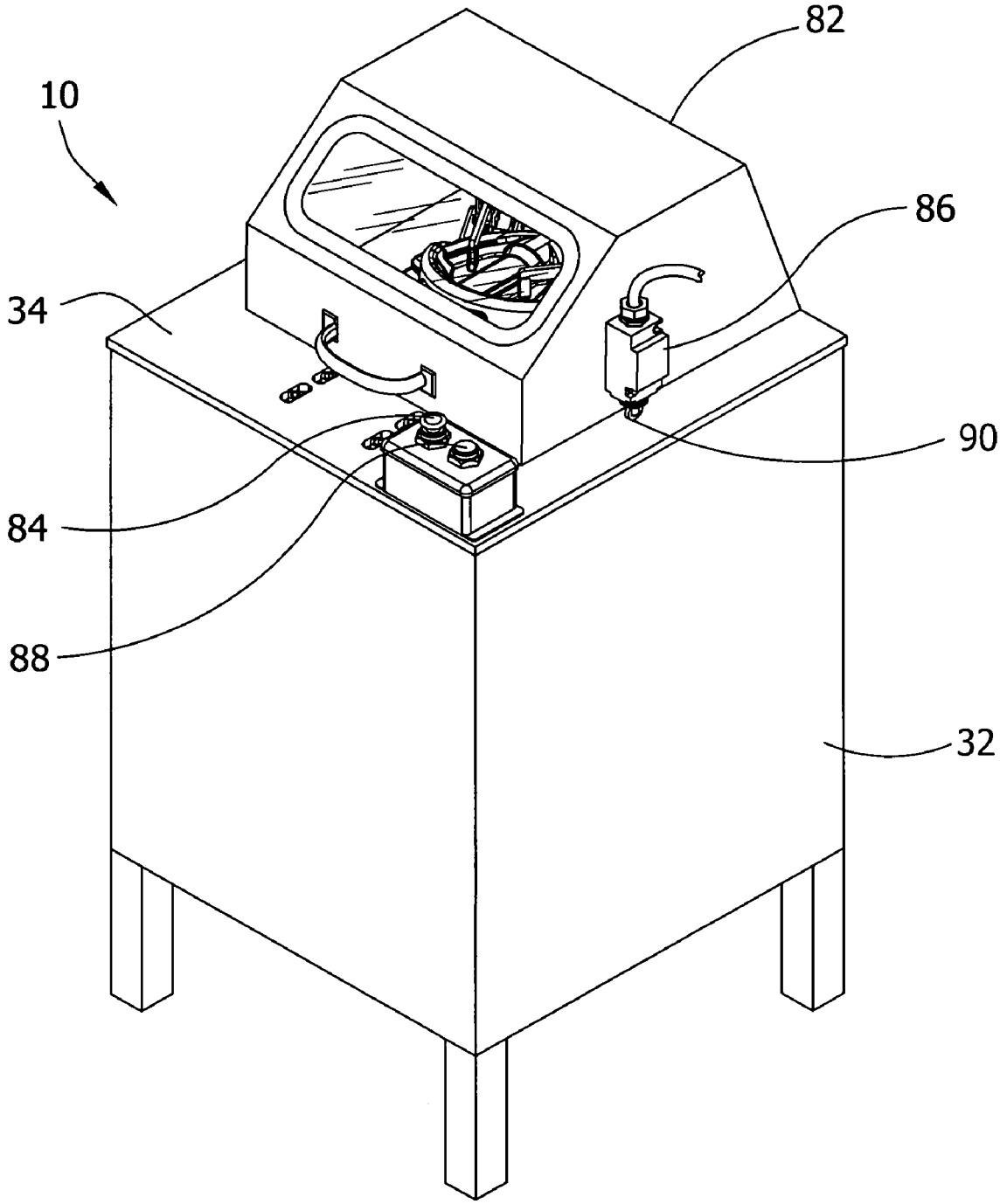
FIG. 16 is a perspective of the machine tool with a lid of the machine tool being in a closed position.

Referring to FIGS. 1 and 16, a lid 82 is pivotally secured to the upper surface 34 of the housing 32. The lid 82 is pivotable between a closed position, wherein the lid covers the platform 38, the rectangular opening 36 and the U-shaped cutout 40 when the tool 10 is in operation, and an open position, wherein the platform, including the positioning fixture 44, is exposed.

In use, the machine tool 10 may be configured in a loading configuration in which the lid 82 is in the open position, the platform 38 is in its upper position (i.e., substantially flush with the upper surface 34 of the housing 32), and the clamps 50 are positioned in the retracted position. The valve component 12 is positioned on the positioning fixture 44, as explained above, such that the T-shaped slot 28, for example, projects off the edge 48 of the platform 38 and is aligned with the head 62 of the cutting tool 60. The clamps 50 are positioned in the engagement position to fixedly secure the valve component 12 to the positioning fixture 44. The lid 82 is positioned in the closed position to cover the valve component 12, the platform 38, the rectangular opening 36 and the U-shaped cutout 40. With the lid 82 closed, the machine tool 10 is in an operating configuration. The cutting tool 60 and the platform 38 are actuated such that the head 62 of the tool rotates and the platform moves downward through the rectangular opening 36. Optionally, where the machine tool comprises the device for trimming other portions of the coating 16 besides portions within cavities, e.g., along the outer periphery of the valve component 12, the device may be actuated before, after or during actuation of the cutting tool 60 and the platform 38.

As the platform 38 moves downward (FIGS. 14 and 15), the rotary head 62 of the cutting tool 60 enters the slot 28 of the valve component 12 and removes the flash protrusion 30 and/or other excess material from the interior surface of the slot. The platform 38 continues to move downward until it reaches its lower position (FIG. 15A). Shortly after reaching its lower position, the platform 38 moves upward toward its original, upper position, and the head 62 of the cutting tool 60 again enters the slot 28 of the valve component 12 and removes any remaining flash protrusions 30 and/or other excess material. The platform 38 continues to move upward until its reaches its upper position, i.e., it starting position (FIG. 13), at which time, the lid 82 is opened, the clamps 50 are retracted, and the valve component 12 may be removed from the positioning fixture 44.

In one embodiment, the majority of the process is automated. For example, after positioning the valve component 12 on the positioning fixture 44, closing the lid 82 actuates the machine tool 10. A sensor 86 may be located on the side of the lid 82, as shown in FIGS. 1 and 16, such that when the lid is closed, a button 90 on the sensor is depressed to automatically activate the machine tool 10. The clamps 50 automatically move into the engagement position and secure the valve component 12 to the positioning fixture 44, after which the cutting tool 10 is automatically actuated if it was not previously, and the platform 38 automatically moves upward and downward to remove the flash protrusion 30 and/or other excess material from the interior surface of the slot 28. Other ways of actuating the machine tool 10 are within the scope of this invention.

The machine tool 10 may also have safety features. One such safety feature may allow the user to stop the machine tool 10 during use. For example, an emergency stop button 84 may be disposed on the device which stops the machine tool 10 if, for example, a problem occurs during use. A reset button 88 may also be disposed on the machine tool for resetting the automated process if, for example, the emergency stop was employed. The machine tool 10 may include other safety features within the scope of the invention.

In one embodiment, the elastomeric coating 16 covering the interior surfaces of the cavity 28 of a machined valve component 12 according to the invention has a smooth, machined finish. The head 62 of the cutting tool 60 may be sized and shaped to machine no more than about 0.2 inches (5.08 mm), and more specifically no more than about 0.1 inches (2.54 mm) from the interior surface defining the cavity 28. This ensures that the cast core 14 at the interior surface of the cavity 28 remains completely covered by the coating 16 while also ensuring the cavity is uniformly sized and shaped.

When introducing elements of the present invention or the preferred embodiments(s) thereof, the articles "a", "an", "the" and "said" are intended to mean that there are one or more of the elements. The terms "comprising", "including" and "having" are intended to be inclusive and mean that there may be additional elements other than the listed elements.

In view of the above, it will be seen that the several objects of the invention are achieved and other advantageous results attained.

As various changes could be made in the above constructions, products, and methods without departing from the scope of the invention, it is intended that all matter contained in the above description and shown in the accompanying drawings shall be interpreted as illustrative and not in a limiting sense.

What is claimed is:

1. A machine tool for removing flashing from interior surfaces of a cavity in a valve component, said tool comprising a platform, a positioning fixture on a top surface of the platform for positioning said valve component on the platform, the positioning fixture including a protrusion receivable in a recess in said valve component so as to position the valve component in a position in which said interior surfaces of the cavity in the valve component are spaced laterally outward from an edge of the platform, a clamp on the platform movable from a retracted position to an engaging position for clamping the valve component against the fixture, a cutting tool having a rotatable cutting head spaced laterally outward from said edge of the platform a predetermined distance from said positioning fixture for cutting the flashing from said interior surfaces of said cavity in said valve component, said platform being movable downward from an upper position to bring said cutting head into cutting engagement with said valve component to remove said flashing from the valve component and being movable back to said upper position after said flashing has been removed.

2. A machine tool as set forth in claim 1 further comprising a cutting tool housing having an upper surface with a platform opening for receiving said platform.

3. A machine tool as set forth in claim 2 further comprising a lid pivoted on said housing for movement between an open position and a closed position covering the platform.

4. A machine tool as set forth in claim 3 further comprising a sensor for actuating operation of the cutting tool, operation of the clamp, and movement of the platform down from its upper position.

5. A machine tool as set forth in claim 2 wherein said upper surface of the housing has a cutout contiguous with said platform opening, for receiving a portion of said valve component containing said cavity.

6. A machine tool as set forth in claim 1 wherein the cutting head of the cutting tool is T-shaped for cutting flashing from said interior surfaces of the valve component.

7. A machine tool as set forth in claim 1 wherein said clamp comprises a base, an arm pivoted on the base, and a power cylinder for moving the clamp between said retracted and engaging positions.

8. A machine tool as set forth in claim 1, said valve component having a cast core substantially covered by a non-uniform elastomeric coating, the coated valve component further including an outer periphery, and wherein said cavity is a T-shaped cavity extending inward from the periphery, said cutting head having a diameter sized relative to the cavity for cutting no more than about 0.2 inches from each of said interior surfaces of the cavity such that the cast core remains completely coated around the cavity.

9. The machine tool of claim 8 wherein the cutting head has a diameter sized to cut no more than 0.1 inches from each of said interior surfaces of the cavity.

10. The machine tool of claim 9 wherein the valve component is a valve wedge.

11. The machine tool of claim 10 wherein the valve wedge includes recesses symmetric about an axis and the positioning fixture includes two symmetric protrusions receivable in the recesses.

12. A machine tool for machining flashing from an elastomeric coated valve component, said tool comprising a platform movable up and down, an upper surface with a platform opening for receiving said platform, a cutout in the upper surface contiguous with said platform opening for receiving a portion of said valve component to be machined, a positioning fixture on the platform for positioning said valve component on the platform, a clamp on the platform movable from a retracted position to an engaging position for clamping the valve component against the fixture, and a cutting tool having a rotatable cutting head disposed below said cutout, said platform being movable downward from an upper position to bring said cutting head into cutting engagement with said valve component to remove said flashing from the valve component and being movable back to said upper position after said flashing has been removed, the cutting head of the cutting tool being T-shaped for cutting flashing from a T-shaped cavity in the valve component.

13. A machine tool as set forth in claim 12, said valve component having a cast core substantially covered by a non-uniform elastomeric coating, the coated valve component further including an outer periphery, and wherein said cavity is a T-shaped cavity extending inward from the periphery, said cutting head having a diameter sized relative to the cavity for cutting no more than about 0.2 inches from each of said interior surfaces of the cavity such that the cast core remains completely coated around the cavity.

14. A machine tool as set forth in claim 12 wherein said upper surface is an upper surface of a housing for said cutting tool.

* * * * *

UNITED STATES PATENT AND TRADEMARK OFFICE

CERTIFICATE OF CORRECTION

PATENT NO. : 7,607,872 B2
APPLICATION NO. : 11/348573
DATED : October 27, 2009
INVENTOR(S) : Hulse et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 883 days.

Signed and Sealed this

Twelfth Day of October, 2010

David J. Kappos

David J. Kappos
*Director of the United States Patent and Trademark Office*